US007708837B2

(12) United States Patent
Kuran et al.

(10) Patent No.: US 7,708,837 B2
(45) Date of Patent: May 4, 2010

(54) DISHWASHER AND CORRESPONDING CONTROL METHOD

(76) Inventors: Ayla Kuran, Arcelik A.S., Bulasik Makinas Isletmesi, Ankara (TR) 06931; Atilla Uz, Arcelik A.S., Bulasik Makinas Isletmesi, Ankara (TR) 06931

( * ) Notice: Subject to any disclaimer, the term of this patent is extended or adjusted under 35 U.S.C. 154(b) by 1050 days.

(21) Appl. No.: 10/540,586

(22) PCT Filed: Dec. 24, 2003

(86) PCT No.: PCT/TR03/00103

§ 371 (c)(1),
(2), (4) Date: Jan. 3, 2006

(87) PCT Pub. No.: WO2004/058038

PCT Pub. Date: Jul. 15, 2004

(65) Prior Publication Data

US 2006/0162746 A1 Jul. 27, 2006

(30) Foreign Application Priority Data

Dec. 25, 2002 (TR) ..... A 2002 02716

(51) Int. Cl.
*B08B 7/04* (2006.01)
*B08B 3/10* (2006.01)
*B08B 9/20* (2006.01)

(52) U.S. Cl. ..... 134/18; 134/1; 134/25.2

(58) Field of Classification Search ..... 134/56 D, 134/18, 25.2; 422/24; 435/287.2
See application file for complete search history.

(56) References Cited

U.S. PATENT DOCUMENTS

| | | | | |
|---|---|---|---|---|
| 5,560,060 | A * | 10/1996 | Dausch et al. | 8/158 |
| 6,138,692 | A * | 10/2000 | Kobos et al. | 134/25.2 |
| 2003/0227394 | A1 * | 12/2003 | Rothgeb et al. | 340/870.01 |

FOREIGN PATENT DOCUMENTS

| | | | |
|---|---|---|---|
| DE | 44 15 823 | A | 11/1995 |
| DE | 4415823 | * | 11/1995 |
| EP | 0 995 483 | A | 4/2000 |
| WO | WO 03 097782 | A | 11/2003 |
| WO | WO 03 099982 | A | 12/2003 |
| WO | WO 03 100153 | A | 12/2003 |

* cited by examiner

*Primary Examiner*—Michael Kornakov
*Assistant Examiner*—Natasha Campbell
(74) *Attorney, Agent, or Firm*—Venable, Campillo, Logan & Meaney PC

(57) ABSTRACT

This invention relates to a dishwasher (1) comprising a bio-sensor (7) and a control method which provides an efficient, clean and hygienic washing wherein the main water supply and washing water are microbiologically analyzed in the phases of the program, and the washing water temperature and circulation period are adjusted in each phase.

8 Claims, 2 Drawing Sheets

DISHWASHER AND CORRESPONDING CONTROL METHOD

BACKGROUND OF THE INVENTION

1. Field of the Invention

This invention relates to a dishwasher and a control method which provide an efficient, clean and hygienic washing.

In addition to the cleaning of the washed appliances it is expected to be purified from the germs. Microbiologic pollution is caused by the microorganisms harmful both for the human health and the environment in natural spring waters or main water supply and the reproduction of the bacteria due to the waiting of the kitchen appliances in the dishwasher for cleansing. In the prior art, additive chemicals mixed with the washing and rinsing water and methods such as additional washing cycles and filtration have been used for the elimination of the harmful microorganisms. U.S. Pat. No. 4,147,559 is related to a method in which a precipitation prepared by means of sterilizing chemicals is given by water tub and water feeding units.

U.S. Pat. No. 5,320,118 is related to the solution and dispense of the sterilizing chemicals.

U.S. Pat. No. 4,156,621 discloses a dishwasher in which the additional chemicals are not used for the purification of a reverse osmosis unit.

2. Summary of the Invention

The object of this invention is to provide a dishwasher and a control method which apply a washing program for microbiologically clean washing and analyze the washing water in certain cycles microbiologically during the program.

BRIEF DESCRIPTION OF THE DRAWINGS

In order to achieve the object of this invention the dishwasher and the respective control method are shown with the attached drawings described below.

DETAILED DESCRIPTION OF THE INVENTION

Figure 1:
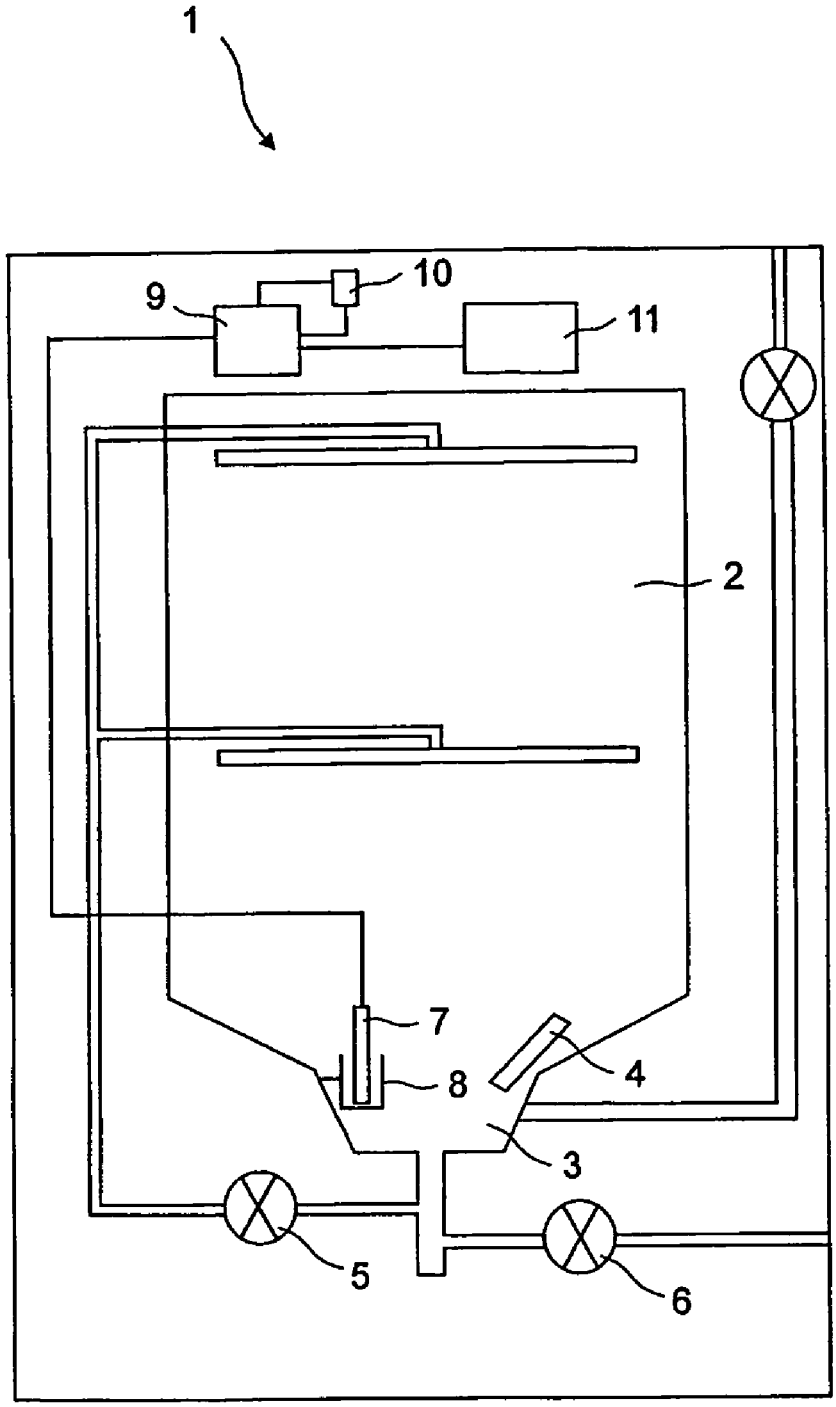
FIG. 1 is a schematic view of a dishwasher.
Figure 2:
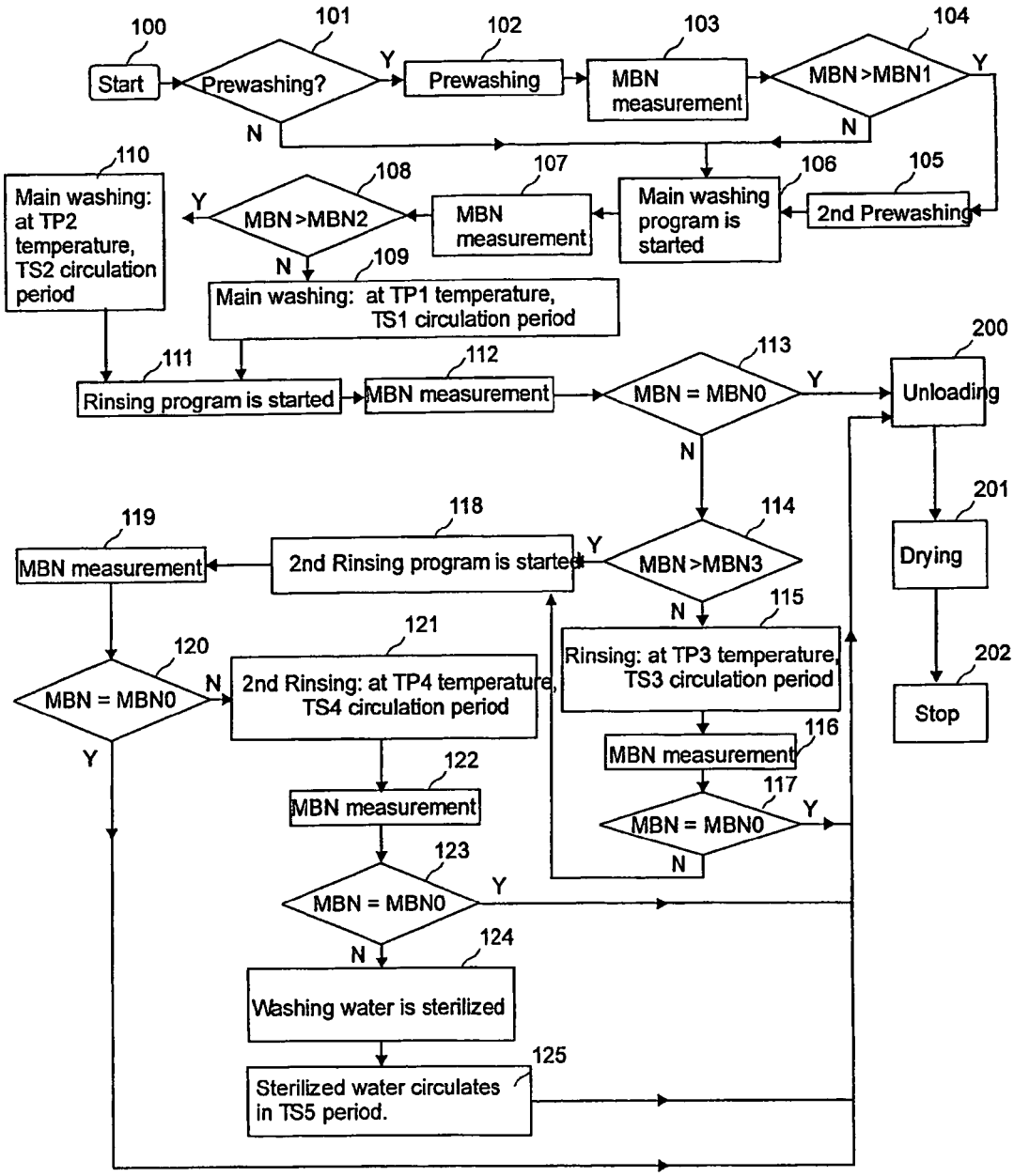
FIG. 2 is a flow diagram of the control method of a dishwasher.

The figures have been each numbered corresponding the following:

1. Dishwasher
2. Washing tub
3. Sump
4. Heater
5. Circulation pump
6. Evacuation pump
7. Biosensor
8. Measurement chamber
9. Microprocessor
10. Memory
11. Control unit The dishwasher (1) comprises a washing tub (2) where the appliances are put, a sump (3) under the washing tub (2) where the water in the washing tub (2) is collected during the washing process, a heater (4) which is used to heat the washing water, a circulation pump (5) which returns the collected water to the washing tub (2), an evacuation pump (6) which discharges the collected water in the sump (3) as a result of the washing process out of the dishwasher (1), a biosensor (7) which detects the microorganisms in the washing water, a measurement chamber (8) which is suitable for taking as much samples as required for measurement from the sump (3) in every cycles of the washing process, a memory (10) to which the parameters to be compared are loaded, a microprocessor (9) which compares the signals with the parameters loaded to the memory (10) and forwards the result of the comparison and a control unit which enables the biosensor (7) to measure in the required cycles of the washing program and arranges the washing program with respect to the data obtained from the microprocessor (9).

The washing cycle in the dishwashers consists of pre-washing, main washing, rinsing, discharge of the washing water and drying cycles respectively.

The microbiologic pollution rate (MBN) is a variant compared with the limit values measured by the biosensor (7) and loaded to the memory (10) by being predetermined as a result of experimental works by the producer.

MBN1: is the limit value of the acceptable microbiologic pollution rate for the pre-washing cycle.

MBN2: is the limit value of the acceptable microbiologic pollution rate for the main washing cycle.

MBN3: is the limit value of the acceptable microbiologic pollution rate for the rinsing cycle.

MBN0: is the accepted microbiologic pollution rate at the negligible level.

In accordance with the data obtained as a result of the comparison of MBN values measured by the biosensor (7) with preloaded limit values, temperature and circulation period used in the washing cycles have already been loaded to the memory (10) by the producer.

TP1: is the temperature applied in the main washing cycle if MBN<MBN2.

TP2: is the temperature applied in the main washing cycle if MBN>MBN2

TP3: is the temperature applied in the rinsing cycle if MBN<MBN3.

TP4: is the temperature applied in the rinsing cycle if MBN>MBN3

TP1: is the circulation period applied in the main washing cycle if MBN<MBN2.

TS2: is the circulation period applied in the main washing cycle if MBN>MBN2.

TS3: is the circulation period applied in the rinsing cycle if MBN>MBN0 and MBN<MBN3.

TS4: is the circulation period applied in the second rinsing cycle if MBN>MBN0 and MBN>MBN3.

TS5: is the circulation period applied by the sterilized water.

The microbiologic pollution rate (MBN) is measured by the biosensor (7) in at least one of washing program cycles such as the pre-washing, main washing and rinsing cycles. MBN is compared with the limit values and accordingly if MBN is higher than the limit values, temperature and/or period and/or repetition number are changed to reduce MBN below the limit values. On the other hand, if MBN is lower than the limit values, the washing period is continued under the predetermined conditions.

In case microbiologic pollution rate (MBN) can not be lowered to the required level by the changes in temperature and/or period, the washing water is sterilized.

In case microbiologic pollution rate (MBN) can not be lowered to the required level by the changes in temperature and/or period, the washing water is changed and the washing cycle is repeated.

A dishwasher (1) comprising a biosensor (7) is controlled as follows:

The user starts the washing cycle (100),

The user selects either the pre-washing or without pre-washing program (101), If the without pre-washing program is selected, main washing cycle is started (106), If the pre-washing program is selected, then the pre-washing program is started (102), Microbiologic pollution rate (MBN) is measured by the biosensor (7) (103), MBN is compared with the limit value of the acceptable microbiologic pollution rate (MBN1) for the pre-washing (104), If MBN<MBN1, main washing cycle (106) is started (106), If MBN>MBN1, a second pre-washing cycle is started (105), Main washing cycle is started (106), Microbiologic pollution rate (MBN) is measured by the biosensor (7) (107), MBN is compared with the limit value of the acceptable microbiologic pollution rate (MBN2) for the main washing (108), If MBN<MBN2, main washing cycle is started in TP1 temperature value and TS1 circulation period (109), If MBN>MBN2, main washing cycle is started in TP2 temperature value and TS2 circulation period (110), Rinsing cycle is started following the main washing (111), Microbiologic pollution rate (MBN) is measured by the biosensor (7) (112), It is checked whether the microbiologic pollution has reached the inefficient level or not (113), If MBN=MBN0, the rising water is discharged (200), If the microbiologic pollution is detected (MBN>MBN0), MBN is compared with the limit values (MBN3) of the acceptable microbiologic pollution rate for the rinsing cycle (114), If MBN>MBN3, second rinsing cycle is started (118), If MBN<MBN3, rinsing cycle is started in TP3 temperature value and TS3 circulation period (115), Microbiologic pollution rate (MBN) is measured by the biosensor (7) (116), It is checked whether the microbiologic pollution has reached the inefficient level or not (117), If MBN=MBN0, the rinsing water is started to be discharged (200), If MBN>MBN0, second rinsing cycle is started (118), Microbiologic pollution rate (MBN) is measured by the biosensor (7) (119), It is checked whether the microbiologic pollution has reached the inefficient level or not (120), If MBN=MBN0, the rinsing water is started to be discharged (200), If MBN>MBN0, second rinsing cycle is started at TP4 temperature value and TS4 circulation period (121), Microbiologic pollution rate (MBN) is measured by the biosensor (7) (122), It is checked whether the microbiologic pollution has reached the inefficient level or not (123), If MBN=MBN0, the rinsing water is started to be discharged (200), If MBN>MBN0, the washing water is sterilized (124), Sterilized water is used for rinsing during TS5 circulation period (125), The rinsing water is discharged (200), The drying cycle is started (201), The cycle is ended (202).

A clean and hygienic washing efficiency is achieved by detecting the microbiologic pollution of the washing environment following the test of the main supply water and the circulating washing water means of a biosensor (7) and adjusting the temperature and the circulation period of the washing water in each cycle accordingly.

In order to sterilize the washing water preferably by UV (Ultraviolet) technique in the dishwasher (1) of the so-called invention, water in the sump (3) is subjected to the beams having germicide wavelength by transferring into a tube comprising an ultraviolet lamp via a circulation pump and the sterilized water is returned to the washing chamber.

In another embodiment of the invention, the TV lamps (Ultraviolet) placed in a suitable way in the washing tub (2) provides the elimination of the germs by affecting the materials in the drying machine (1) joining the cycle in the drying cycle following the washing cycle.

The invention claimed is:

1. A control method for a dishwasher (1) having a washing tub (2) where appliances are put, a sump (3) under the washing tub (2) where water in the washing tub (2) is collected during the washing process, a biosensor (7) which detects the microorganisms in the washing water, a memory (10) to which parameters to be compared are loaded, including acceptable maximum microbiologic pollution rates (MBN0, MBN1, MBN2, MBN3) preloaded by the producer, a microprocessor (9) which compares signals produced by a biosensor (7) including a microbiologic pollution rate (MBN) measured by the biosensor in a washing cycles is compared with the parameters loaded to the memory (10) and forwards the result of the comparison and a control unit (11) which arranges the washing program with respect to the data obtained from the microprocessor (9) comprising the steps below:

A user starts a washing cycle (100),

The user selects either a pre-washing or a without pre-washing program (101), If the without pre-washing program is selected, main washing cycle is started (106), If the pre-washing program is selected, then the pre-washing program is started (102), The Microbiologic pollution rate (MBN) is measured by the biosensor (7) (103), The MBN is compared with a limit value of the acceptable microbiologic pollution rate (MBN1) for the pre-washing program (104), If MBN<MBN1, main washing cycle (106) is started (106), If MBN>MBN1, a second pre-washing cycle is started (105), The Main washing cycle is started (106), The Microbiologic pollution rate (MBN) is measured by the biosensor (7) (107), The MBN is compared with the limit value of a acceptable microbiologic pollution rate (MBN2) for a main washing (108), If MBN<MBN2, main washing cycle is started in TP1 temperature value and TS1 circulation period (109), If MBN>MBN2, main washing cycle is started in TP2 temperature value and TS2 circulation period (110), The Rinsing cycle is started following the main washing (111), The Microbiologic pollution rate (MBN) is measured by the biosensor (7) (112), It is checked whether the microbiologic pollution has reached the accepted microbiologic pollution rate at the negligible level (MBN0) or not (113), If MBN=MBN0, a rinsing water is discharged (200), If the microbiologic pollution is detected (MBN>MBN0), MBN is compared with the limit values (MBN3) of the acceptable microbiologic pollution rate for the rinsing cycle (114), If MBN>MBN3, second rinsing cycle is started (118), If MBN<MBN3, rinsing cycle is started in TP3 temperature value and TS3 circulation period (115), Microbiologic pollution rate (MBN) is measured by the biosensor (7) (116), It is checked whether the microbiologic pollution has reached the accepted microbiologic pollution rate at the negligible level (MBN0) or not (117), If MBN=MBN0, the rinsing water is started to be discharged (200), If MBN>MBN0, second rinsing cycle is started (118), Microbiologic pollution rate (MBN) is measured by the biosensor (7) (119), It is checked whether the microbiologic pollution has reached the accepted microbiologic pollution rate at the negligible level (MBN0) or not (120), If MBN=MBN0, the rinsing water is started to be discharged (200), If MBN>MBN0, second rinsing cycle is started at TP4 temperature value and TS4 circulation period (121), Microbiologic pollution rate (MBN) is measured by the biosensor (7) (122), It is checked whether the microbiologic pollution has reached the accepted microbiologic pollution rate at the negligible level (MBN0) or not (123), If MBN>MBN0, the rinsing water is started to be discharged (200), If MBN>MBN0, the washing water is sterilized (124), Sterilized water is used for rinsing during TS5 circulation period (125), A rinsing water is discharged (200), A drying cycle is started (201), and The drying cycle is ended (202).

2. The control method for a dishwasher (1) as in claim 1 wherein the washing water is sterilized by UV (Ultraviolet) technique in the sterilization cycle (124) of the washing water if MBN>MBN0.

3. The control method for a dishwasher (1) as in claim 1, wherein, the biosensor (7) is placed in a measurement chamber (8) which is suitable for taking as much samples as required for measurement from the sump (3) in every cycle of the washing process.

4. The control method for a dishwasher (1) as in claim 1, wherein, a memory (10) comprising the temperature values (TP1, TP2, TP3, TP4) which are preloaded by the producer and applied in the washing cycles with respect to the results of the comparison with the limit values of the microbiologic pollution rate (MBN) measured by the biosensor (7) in the washing cycle.

5. The control method for a dishwasher (1) as in claim 1, wherein the memory (10) comprising the circulation periods (TS1, TS2, TS3, TS4) which are preloaded by the producer and applied in the washing cycles with respect to the results of the comparison with the limit values of the microbiologic pollution rate (MBN) measured by the biosensor (7) in the washing cycle.

6. The control method for a dishwasher (1) as in claim 1 comprising the steps of the measurement of the microbiologic pollution rates (MBN) by the biosensor (7) in at least one of the washing cycles; the comparison of MBN with the limit values; accordingly the change of temperature and/or period and/or repetition number to reduce MBN below the limit values if measured MBN is higher than the limit values and the continuation of the washing period under the predetermined conditions if MBN is lower than the limit values.

7. The control method for a dishwasher (1) as in claim 1 characterized in that the washing water is sterilized if the microbiologic pollution rate (MBN) can not be lowered to the required level by the changes in temperature and/or period.

8. The control method for a dishwasher (1) as in claim 1 characterized in that the washing water is changed and the washing cycle is repeated, if the microbiologic pollution rate (MBN) can not be lowered to the required level by the changes in temperature and/or period.

* * * * *